United States Patent [19]

Yang

[11] Patent Number: 4,619,094

[45] Date of Patent: Oct. 28, 1986

[54] NON-PENETRATING MECHANICAL FASTENER FOR ROOFING MEMBRANE AND METHOD OF APPLYING SAME

[75] Inventor: James H. C. Yang, Cleveland, Ohio

[73] Assignee: The Firestone Tire & Rubber Company, Akron, Ohio

[21] Appl. No.: 807,632

[22] Filed: Dec. 11, 1985

[51] Int. Cl.[4] ..... E04D 1/34; E04D 5/14

[52] U.S. Cl. ..... 52/410; 52/509; 135/119; 160/349; 24/90 C

[58] Field of Search ..... 52/410, 713, 741, 747, 52/748, 595, 63, 512, 509, 506; 285/94; 24/113, 90 C, 461, 462, 459; 160/380, 399, 402; 411/531, 542; 135/119

[56] References Cited

U.S. PATENT DOCUMENTS

| | | | |
|---|---|---|---|
| 2,903,148 | 9/1959 | Keller | 215/45 |
| 3,151,758 | 10/1964 | Marler | 215/45 |
| 3,426,412 | 2/1969 | Streng et al. | 24/243 |
| 3,984,958 | 10/1976 | Murray | 52/468 |
| 4,189,880 | 2/1980 | Ballin | 52/202 |
| 4,502,256 | 3/1985 | Hahn | 52/63 |
| 4,519,175 | 5/1985 | Resan | 52/713 |
| 4,520,606 | 6/1985 | Francovitch | 52/410 |
| 4,534,145 | 8/1985 | Yang | 52/222 |

FOREIGN PATENT DOCUMENTS

| | | |
|---|---|---|
| 737640 | 7/1966 | Canada . |
| 2433669 | 1/1976 | Fed. Rep. of Germany . |
| 209864 | 3/1965 | Sweden . |
| 2060752 | 5/1981 | United Kingdom . |

*Primary Examiner*—J. Karl Bell

*Attorney, Agent, or Firm*—Ernst H. Ruf

[57] ABSTRACT

A non-penetrating mechanical fastener for securing a flexible sheet of an elastomeric material to the upper surface of a roof via the use of a plurality of such fasteners, each of which includes upper and lower members, wherein the latter are anchored to the roofing surface. The upper member includes an inner resilient retainer and an outer locking cap which clamp the sheet about an annular knob formed on the lower member. The locking cap is engaged by a compression fit with the resilient retainer to secure the retainer in position about the annular knob. A bolt and nut securely attaches the locking cap to the retainer to prevent their disengagement from the annular knob of the lower member. A method for securing the flexible sheet to the roofing substrate also is presented.

22 Claims, 10 Drawing Figures

NON-PENETRATING MECHANICAL FASTENER FOR ROOFING MEMBRANE AND METHOD OF APPLYING SAME

TECHNICAL FIELD

The field of art to which this invention pertains is that of mechanical fasteners and particularly to a fastener for mechanically securing a flexible sheet or membrane to the roof without penetrating the membrane and to the method of applying the same.

BACKGROUND ART

A large number of commercial and factory plant roofs are of a flat roof design wherein the roofing material itself is often of a built-up asphalt and in more modern systems of a single ply EPDM elastomeric sheet or membrane. In terms of securing a single ply EPDM membrane to the roof itself, one design utilizes a mechanical ballast system that uses a layer of stone over the membrane. While the ballast system is least expensive it has a disadvantage of being quite heavy (approximately 10 pounds per square foot) thus requiring a heavy roof support structure and in addition the roof slope cannot exceed 10%.

Adhered roof membrane retention systems suffer from the cost penalty while mechanical fasteners and related fastening systems generally require fixation to the roofing substrate via mechanical fasteners. There are two basic kinds of mechanical fasteners namely, membrane penetrating and non-penetrating ones. Each of these types of fasteners has a number of favorable features and each of them is also subject to various drawbacks and disadvantages.

Mechanical fastening systems of the penetrating type generally require fixation to the roofing substrate by a metal fastener with metal or rubberized nailing strips. U.S. Pat. Nos. 4,445,306; 4,074,501; 4,455,804; and 4,467,581 are examples of penetrating type fastening systems in which various rigid and semi-rigid members are used to secure the membrane to the roof. These systems require openings to be formed in the membrane either for receiving a fastening plate or by the attaching anchoring members.

Examples of a non-penetrating type fastener are shown in German Patent Publication No. 24 33 669 in which the membrane fastener comprises a lower disc which is attached to a roofing substrate by an anchoring member. The roofing membrane is fitted over the lower disc and an upper disc is snapped over the lower disc to perfect the fastening and exert a sealing effect. In another embodiment of this Patent Publication, a plug is driven into the upper disc to expand the body thereof into an annular space provided in the lower disc to anchor the upper disc thereto. Another type of non-penetrating fastening system is shown in U.S. Pat. No. 3,426,412 which has a flexible fastening cover which is snapped over a base member to trap the membrane therebetween. Another embodiment shown in this U.S. patent uses a plug-like member which is snap-fitted into a recess formed in a lower member which is rigidly connected to the roof to trap and clamp the membrane therebetween. U.K. patent application No. GB 2,060,752 shows another type of non-penetrating fastener for use for attaching flexible film to rigid frame members in the construction of a greenhouse or the like.

Still another type of non-penetrating fastener which is believed to be the closest to my invention is shown in U.S. Pat. No. 4,519,175. The fastener of this patent consists of a knobbed base plate which is anchored to the roof over which the membrane is placed. A stiff externally threaded retainer is formed by a plurality of separate skirt members and is snapped over the knob of the base plate securing the membrane to the plate. An externally threaded cap is screwed onto the retainer which clamps the skirt members about the knobbed top of the base plate. The retainer must be formed of a rigid plastic material in order to have the external threads formed in the outer surface thereof for cooperation with the internal threads on the locking cap. This stiff retainer occasionally will pinch the roof membrane resulting in a weak area in the membrane or can tear the membrane sufficiently to result in a leak. This recognized problem is apparently overcome by the use of a lubricant on the inner surface of the retainer which clamps against the membrane.

Although both the penetrating and non-penetrating type fastening systems do work satisfactory for many applications, it is desirable to have a non-penetrating system for certain applications to eliminate piercing the membrane. Also such a fastener can be installed in a minimum amount of time and without requiring skilled labor, and the fastening element can be securely retained in clamping engagement with the trapped membrane to reduce the accidental disengagement thereof upon the membrane experiencing severe uplift wind forces.

Another problem that exists with certain of the roof fastening systems and in particular the non-penetrating type is the relative ease by which vandals can remove the exposed locking component of the fastener. Although this is not a problem for many installations since the roofs are inaccessible to outsiders, it can be a problem for those buildings that are readily accessible and for buidings subject to vandalism such as schools. In most known prior non-penetrating fasteners, the locking cap or component can be pried off or unscrewed and removed easily without requiring special tools.

DISCLOSURE OF THE INVENTION

Objectives of the invention include providing an improved mechanical fastener for a roofing membrane and a method of applying the same in which the membrane is secured to the roof without any opening or puncture being imparted into the membrane thereby lessening the possibility of membrane damage during installation; in which a plurality of the fasteners can be placed in various arrangements over the roof surface to provide the required holding power; and in which the fasteners can be installed in a minimum amount of time and in an extremely efficient manner while reducing the possibility of the fasteners being installed incorrectly and without the use of any lubricant.

Another object of the invention is to provide such an improved fastener and method in which a lower member of the fastener is rigidly attached to the roof at selected locations with one or more securing anchors after which the membrane is spread over the roof and the attached lower members followed by the subsequent mounting of a resilient retainer and cap on each of the lower members which traps and secures the membrane therein, after which the cap is locked in position by a locking bolt or other securing device. A still further objective is to provide a fastener and method in which the flexible retainer has an annular rib which engages a complementary shaped groove formed in the cap, or in which the retainer and cap have inwardly extending conical walls to assist in locking the retainer and cap on the flared knob of the base plate.

A further objective is to provide such an improved fastener and method in which the retainer includes a resilient member and a metal lock nut which is molded within the resilient retainer or formed as a separate component and removably mounted on the retainer, having a threaded opening for cooperation with the locking bolt.

A still further objective of the invention is to provide such an improved fastener which may be formed out of a rigid lightweight metal such as aluminum, or a rigid plastic material; in which the fastener can be mass produced relatively inexpensively, yet provide an extremely sturdy and durable member which will secure the membrane to the roof and will retain the membrane in the installed position over a considerable period of time without damage to the membrane and which will enable the membrane to withstand the required wind forces without additional ballast, tiedown or fastening members which require the membrane to be pierced and without the use of a lubricant to prevent damage to the membrane as required in certain prior art fastening systems. Another objective is to provide such a fastener which can be produced in various sizes and for use with various thicknesses of membranes; and in which the fastener is able to be used on any flat or irregular roofing geometry such as dome shaped roofs, since the fastener can be placed at various positions on the roof with the flexible membrane conforming to the shape and configuration of the roof.

Still another objective of the invention is to provide such an improved fastener and method for installing the same in which the base plate of the fastener may have an external annular flange that is provided with a plurality of anchoring holes or in which a single anchoring hole can be formed in the area of the base plate which is located within the interior of an annular knob, which knob is engaged by the resilient retainer and cap; and in which the retainer and cap can be formed of various sizes to provide various amounts of clamping action for trapping and securing the membrane about the annular knob of the lower member; and in which the fastener and method provides an extremely inexpensive and efficient device and method of installing the same which achieves the objectives of the invention in a simple, economically and efficient manner.

These objectives and advantages are obtained by the improved mechanical fastener of the invention, the general nature of which may be stated as a fastener for securing a flexible elastomeric sheet to the upper surface of a roof wherein said fastener includes a rigid base plate formed with an upwardly extending projection adapted to be secured to the upper surface of the roof and underlie the elastomeric sheet; anchoring means for securing the base plate to the upper surface of the roof; resilient retainer means mounted on the base plate projection for engaging the elastomeric sheet located between said retainer means and projection; cap means mounted on the retainer means by a force-fit engagement with the retainer means for placing and maintaining the retainer means in a compressed state for clamping the elastomeric sheet between said retainer means and projection; and locking means for locking the cap means on the retainer means to maintain the elastomeric sheet in clamped engagement between the base plate projection and retainer means.

The objectives and advantages are further obtained by the improved method of the invention, the general nature of which may be stated as a method for mechanically securing a flexible elastomeric sheet to the upper surface of a roof via the use of a plurality of spaced non-penetrating fastening devices, each of said fastening devices includes a base plate having an upstanding knob, and with said locking cap assembly including a resilient retainer, a rigid cap and a locking device; and anchoring means for securing said base plate to said roof upper surface; said method comprising the steps of anchoring a plurality of the base plates at spaced locations to the upper surface of the roof; spreading the flexible elastomeric sheet over the roof upper surface and anchored base plate; placing a resilient retainer and cap on the elastomeric sheet above the knob of each of the base plates; forcing the cap toward the base plate to move the retainer into the cap and compressing the retainer about the base plate knob to clamp and secure the elastomeric sheet between the knob and retainer; and securing the retainer to the cap by the locking device.

BRIEF DESCRIPTION OF THE DRAWINGS

A preferred embodiment of the invention, illustrative of the best mode in which applicant has contemplated applying the principles is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
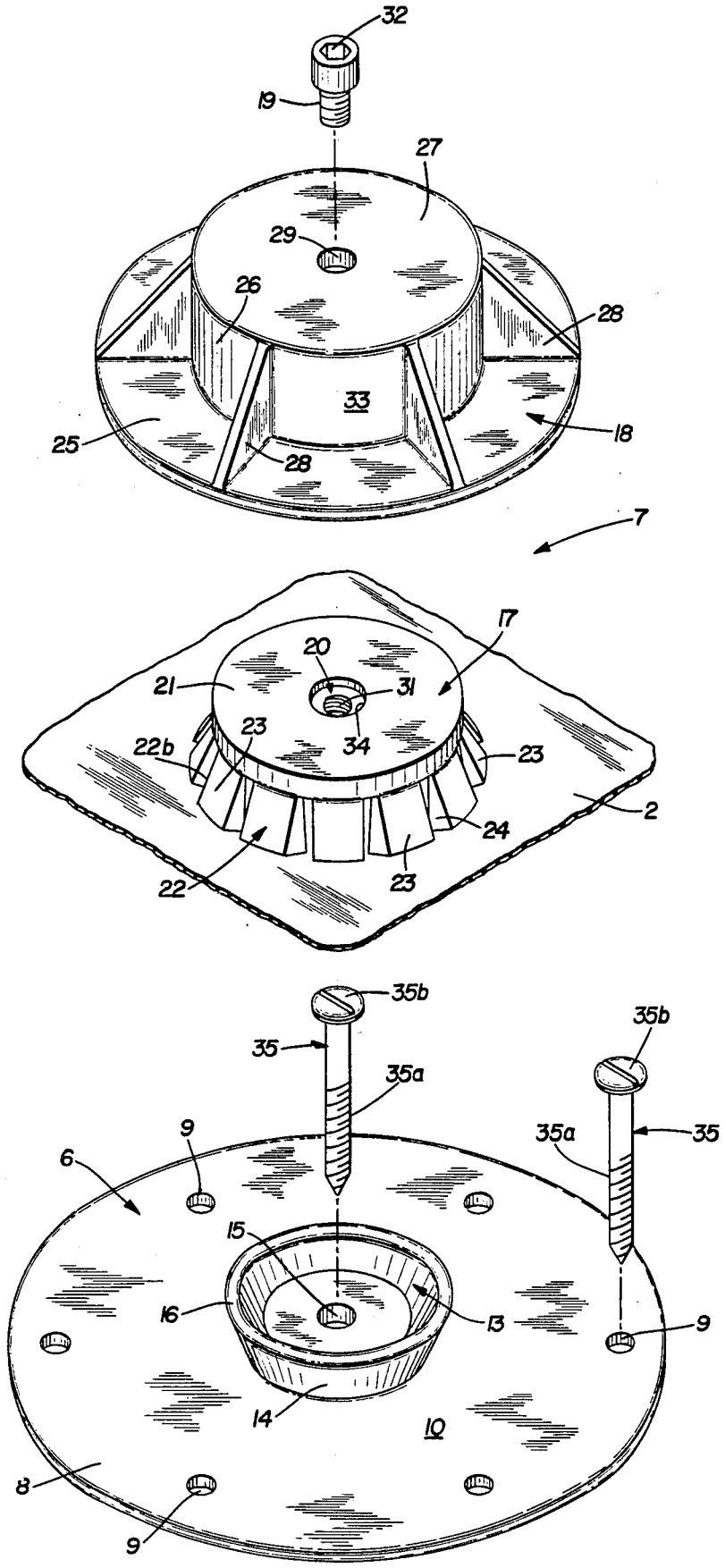
FIG. 1 is an exploded perspective view showing the improved mechanical fastener for securing a flexible membrane on a roof, a portion of the membrane being shown therein.
Figure 2:
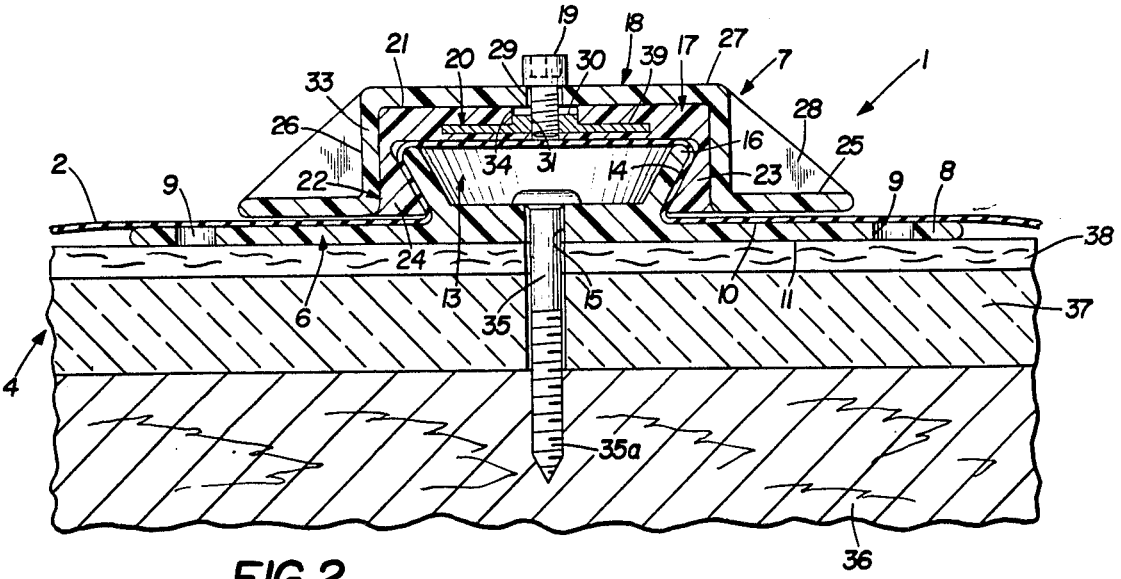
FIG. 2 is a fragmentary sectional view of the improved mechanical fastener of FIG. 1 securing a membrane on the roof.

The improved mechanical fastener is indicated generally at 1, and is shown in an exploded position in FIG. 1 together with a portion of a roof membrane 2. Fastener 1 is shown in FIG. 2 securing membrane 2 onto the upper surface of a roof indicated generally at 4. In a typical installation, a plurality of fasteners 1 will be spaced in a predetermined fashion on the roof surface, the number of which is dependent upon the particular thickness of the membrane, the roof configuration and the various wind loads which will be exerted on the membrane.

Fastener 1 includes a rigid lower member or base plate indicated generally at 6, and a locking cap assembly indicated generally at 7 which is shown in an exploded position in FIG. 1. Base plate 6 has a flat disc-shaped bottom member 8 formed with a plurality of holes 9 arranged in a spaced circular arrangement about member 8. Member 8 has smooth top and bottom surfaces 10 and 11, respectively.

A projection in the form of an annular shaped knob 13 is formed integrally with and projects upwardly from bottom member 8. Knob 13 is formed by a downwardly inwardly tapered hollow conical wall 14 terminating in rounded top edge 16. Another mounting hole 15 preferably is formed in bottom member 8 at the center of hollow knob 13. Base plate 6 preferably is formed of a rigid plastic material although it could be formed of metal if desired.

Locking cap assembly 7 includes a retainer indicated generally at 17, a cap indicated generally at 18, and a lock device consisting of a bolt 19 and a nut 20. Retainer 17 (FIGS. 1 and 2) has a generally annular configuration, and in accordance with one of the features of the invention is formed of a resilient elastomeric material having a disc-shaped top wall 21 and an annular skirt, indicated generally at 22. Skirt 22 is formed by a plurality of individual skirt segments 23 which are integral with top wall 21 and which extend in a downwardly outwardly flared direction therefrom. Segments 23 provide skirt 22 with a smooth cylindrical inner surface **22*a* (FIG. 8) and an outwardly flared outer surface 22*b*. Skirt 22 increases in thickness from top wall 21 terminating in a thickened bottom portion 24. If desired skirt 22 may have an axially extending outer surface 22*b* with inner surface 22*a*** extending inwardly without affecting the results achieved thereby.

Cap 18 preferably is formed of a rigid plastic material having an annular shaped bottom wall 25 and a housing 33. Housing 33 is formed by an upstanding cylindrical side wall 26 which is open at one end and closed at an opposite end by a top wall 27. Side wall 26 is connected to bottom wall 25 by a plurality of reinforcing flanges 28. A hole 29 is formed in the center of top wall 27 for receiving bolt 19 therethrough. Nut 20 is shown particularly in FIGS. 2 and 8 and has a flat elongated disc-shaped base 39 with a central upstanding boss 30 provided with a threaded opening 31 for threaded engagement with bolt 19. Bolt 19 preferably has a recess 32 formed in the top thereof for receiving a wrench or similar installation tool.

As shown in FIG. 2, nut 20 is bonded within the elastomeric material of top wall 21 of retainer 17 with boss 30 extending upwardly through a complementary shaped hole 34 formed in top wall 21 for receiving bolt 19. As shown in FIGS. 1 and 2, base plate 6 is secured by one or more anchoring devices 35 into a main roof deck 36 which may be covered with a sheet of insulation 37 and a top roof panel 38. Anchoring devices can be screws, nails, expansion bolts, or the like each of which has a shank **35*a* and a head 35*b***.

A plurality of base plates 6 are placed in a spaced relationship throughout the top surface of the roof on roof panel 38. The number of base plates 6 and their location will depend upon the size of mechanical fastener 1, the thickness and size of membrane 2, the particular construction of roof 4 and the particular wind loads to which the membrane is designed to withstand. Base plate 6 is secured either with a single anchor 35 through center mounting hole 15 or for certain installations with two or more anchors 35 through mounting holes 9. Mounting holes 9 provide alternative locations for receiving anchors should voids or other obstacles be encountered when attempting to fasten base plate 6 to a roof. In most installations, only one or two anchors 35 are required.

After the desired number of base plates 6 are rigidly secured to the roof, membrane 2 is layed over the installed base plates and workmen will then install a locking cap assembly 7 at each base plate location. Retainer 17 and cap 18 are placed on top of the membrane at each base plate location. Cap 18 is then pressed downwardly against retainer 17 moving the retainer downwardly toward knob 13 with the retainer entering cap housing 33 until top wall 21 of the retainer bottoms out against the inside surface of cap top wall 27 as shown in FIG. 2. Cap 18 will force retainer skirt 22 inwardly about conical wall 14 of the base plate knob 13 and will place it in a compressed state, thus clamping membrane 2 against the knob. Cap 18 can be installed manually or with a tool. Conical wall 14 of knob 13 will coincide with the inside surfaces of skirt segments 23 which will form an annular undercut within the interior of retainer 17 due to thickened ends 24 of skirts segments 23, for receiving knob 13 to trap membrane 2 therebetween. The bottoming out of cap 18 with retainer 17 will insure that skirt segments 23 are tightly clamped about conical knob wall 14 by the engagement of the smooth inside surface of annular wall 26 of cap 18 with the smooth outer surface **22*b* of skirt segments 23. The flat bottom surface of cap bottom wall 25 will lie adjacent an annular portion of membrane 2 but need not pressingly engage the membrane since the membrane is secured in a trapped clamped position about knob 13 by the pressure exerted by compressed resilient retainer skirt 22**.

In accordnce with one of the main features of the invention, bolt 19 is then inserted through hole 29 of cap wall 27 and is engaged with threaded opening 31 of nut 20 to securely lock cap 18 to retainer 17. This locking feature reduces the possibility of cap 18 becoming loose from its clamped engagement with retainer 17 over an extended period of time even upon experiencing strong wind forces thereon, and further reduces the possibility of vandals removing caps 18 from their clamped position with retainers 17 since it can be configured to require a special tool to unscrew bolt 19 from nut 20.

The smooth inside surface of cap cylindrical wall 26 is generally complementary with the outer surfaces of skirt segments 23 so that when retainer 17 is firmly positioned within housing 33 of cap 18, skirt segments 23 will be compressed inwardly into engagement with conical wall 14 of knob 13 to form the annular undercut recess thus preventing the upward movement of retainer 17 and lock cap 18. The resiliency of retainer 17 and in particular the resiliency of skirt 22, which are placed in a compressed or stressed condition by housing side wall 26 of cap 18, reduces the possibility of pinching or damaging the trapped portion of membrane 2 which occurs in prior art non-penetrating fasteners in which such a retaining member is formed of a rigid plastic material in contrast to the resilient elastomeric material of retainer 17. Furthermore, the engagement of locking bolt 19 with nut 20 secures cap 18 to retainer 17 when both members are in the engaged position with base plate 6. The rounded top edge 16 of conical knob 13 will not cut into membrane 2 since most all of the clamping force is exerted against smooth conical wall 14 of the knob thus further eliminating any sharp pinch points. When installing retainer 17 and cap 18, a snap-fit type action takes place as retainer skirt 22 is compressed inwardly about knob 13 by the axial sliding engagement with cap housing 33. As can be seen in FIG. 2, retainer 17 will maintain a constant clamping pressure against the membrane since skirt 22 is trapped within housing 33.

In terms of the method or process for utilizing non-penetrating fastener 1, a plurality of base plates 6 are secured to roof 4 by anchors 35 after which membrane 2 is layed-over the roof and base plates. Retainer 17 and base cap 18 then are installed at each base plate location to securely clamp the membrane to knob 13 after which bolt 19 is engaged with nut 20 to firmly secure retainer 17 to cap 18. The location of each base plate will be readily detected by a slight upward bulge of the membrane at each base plate location and a workman can easily see and feel knob 13 for installing retainer 17 and cap 18 manually or with an appropriate installation tool thereon. As discussed above, in installing base plates 6, one or more anchoring devices may be used depending upon the structure of the roof and particular roof covering application. The plurality of holes 9 spaced about base plate 6 generally insures that at least one or two anchoring devices will provide a firm engagement with the roof. Base plate 6, cap 18, bolt 19 and nut 20 preferably are made of a rigid plastic material or a lightweight metal with retainer 17 being formed of a resilient elastomeric material to be compressed within the cap housing and which will prevent damaging the clamped membrane.

Figure 3:
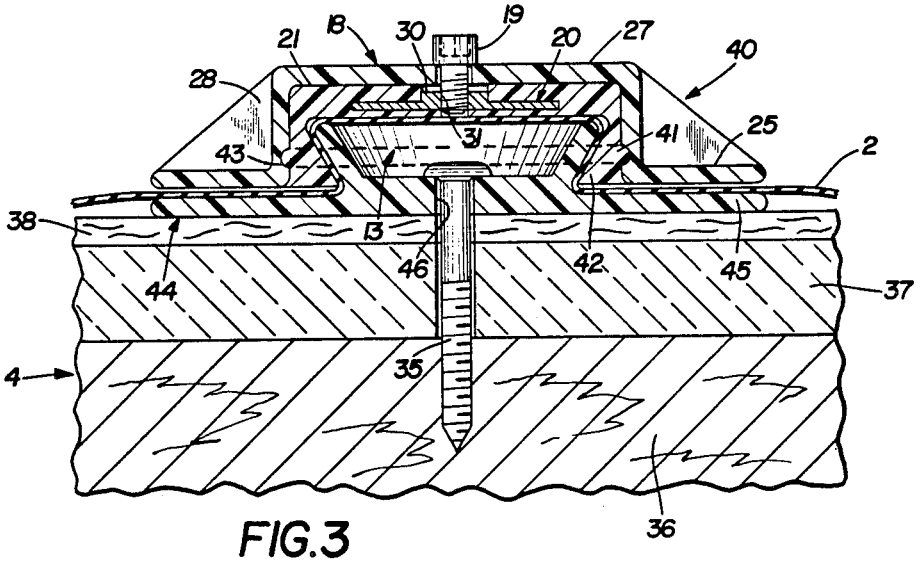
FIG. 3 is a fragmentary sectional view of a modified form of the improved mechanical fastener of FIGS. 1 and 2.
Figure 5:
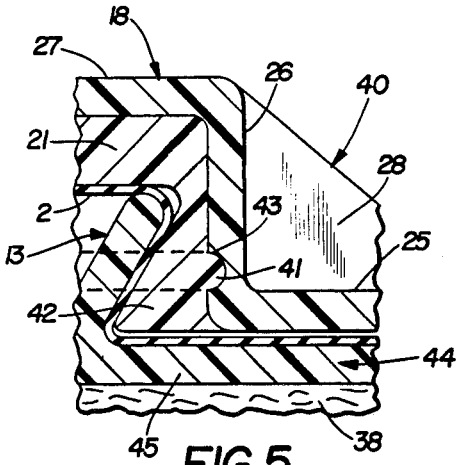
FIG. 5 is an enlarged fragmentary sectional view of a portion of the mechanical fastener embodiment shown in FIG. 3.

A modified form of the improved fastener is indicated generally at 40 and is shown in FIGS. 3 and 5. Fastener 40 is similar in nearly all respects to fastener 1 except that an outwardly extending projection 41 is formed on each skirt segment 42, which are similar to skirt segments 23 described above, to form an annular rib extending about the lower end of the retainer skirt. This rib is located within a complementary shaped annular groove 43 which is formed on the inside of cylindrical housing wall 26 of cap 18. A base plate 44 is nearly identical to base plate 6 of fastener 1 except that the disc-shaped bottom member 45 is of a smaller diameter, generally complementary to the diameter of disc-shaped bottom wall 25 of cap 18 and is formed without any circularly spaced mounting holes 9. In this construction, base plate 44 will always be installed with a single anchor 35 extending through a central hole 46 formed in the base plate. The method of installation of modified fastener 40 is the same as fastener 1 described above.

Figure 4:
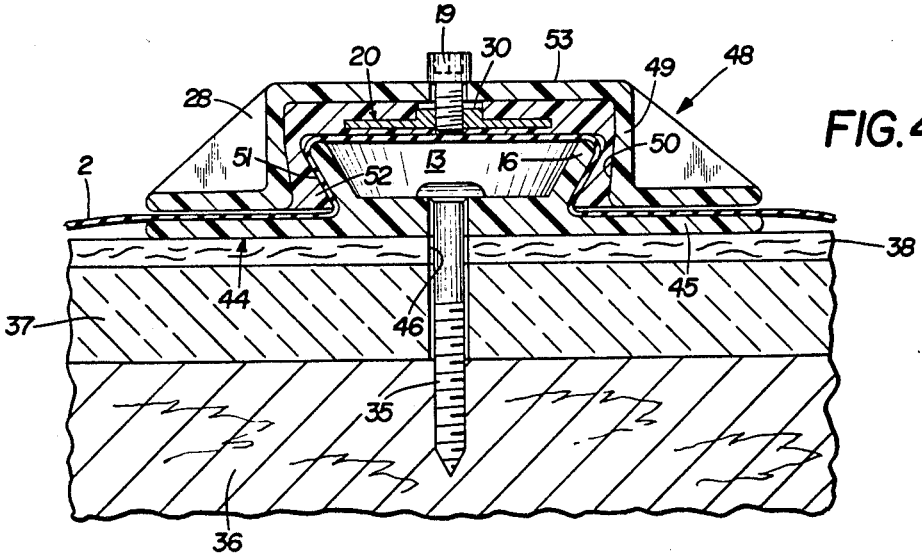
FIG. 4 is a fragmentary sectional view of another modified form of the improved mechanical fastener.
Figure 6:
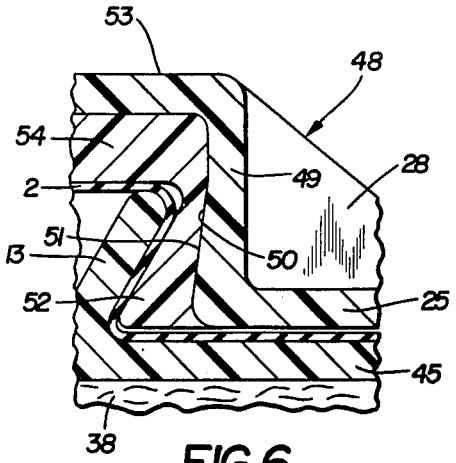
FIG. 6 is an enlarged fragmentary sectional view of a portion of the modified mechanical fastener shown in FIG. 4.

Another modification to the improved fastener is indicated generally at 48, and is shown in FIGS. 4 and 6. Fastener 48 is similar to fasteners 1 and 40 except that cap housing cyindrical wall 49 is formed with an inwardly tapered inner wall surface 50 which engages wall surface 51 of retainer skirt 52 which may or may not be correspondingly tapered. This configuration will provide a tighter clamping engagement between cap 53 and retainer 54 than that provided by cap 18 and retainer 17 of fastener 1 having the generally straight engaged cylindrical surfaces thereof.

The modifications to the cap and retainer shown in FIGS. 3, 4, 5 and 6, provide alternate constructions which may be desirable for certain applications to increase the clamping action and engagement between the cap and retainer for clamping the membrane against the annular knob of the base plate. The smaller diameter of the base plate bottom wall for modified fasteners 40 and 48 in contrast to the larger diameter of bottom wall 25 of base plate 6 results in less material while still providing the satisfactory means for securing the base plate to the roof surface.

Figure 7:
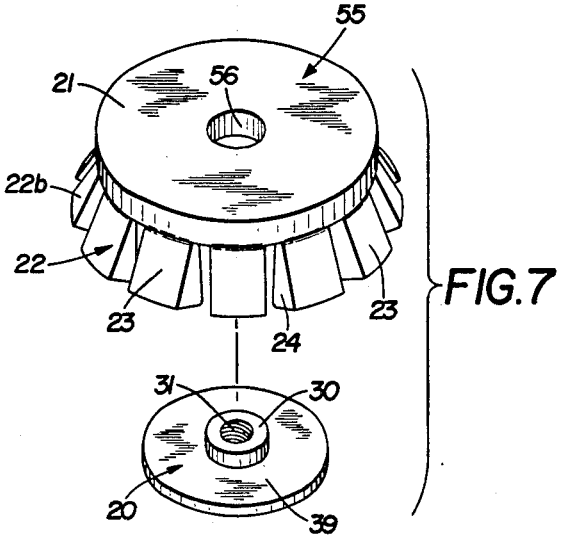
FIG. 7 is an exploded perspective view of a modified retainer and locking nut of the improved fastener.
Figure 8:
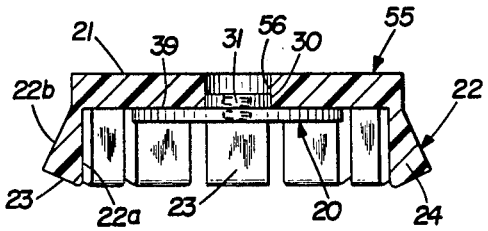
FIG. 8 is an assembled view of the retainer of FIG. 7.
Figure 9:
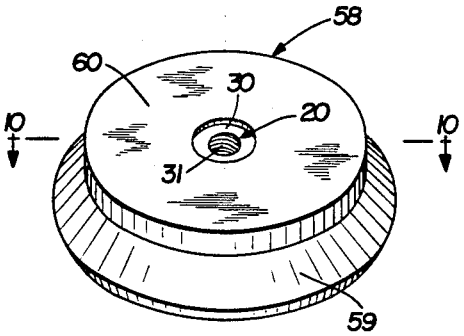
FIG. 9 is a perspective view of another modified form of the retainer and lock nut of the improved mechanical fastener.
Figure 10:
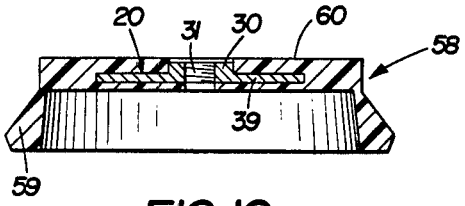
FIG. 10 is a sectional view taken on line 10—10, FIG. 9.

A modified retainer is indicated generally at 55 and is shown in FIGS. 7 and 8, and is similar to retainer 17 of fastener 1 except that nut 20 is not molded within top wall 21 of the retainer but is unattached with boss 30 being slidably inserted through opening 56 formed in cap wall 21. Another modified retainer is indicated generally at 58 and is shown in FIGS. 9 and 10. Retainer 58 is formed of a resilient elastomeric material, as are retainers 17 and 55, except that skirt 59 is formed as an integral continuous one piece member with disc-shaped top wall 60 in which nut 20 is bonded being formed without a plurality of individual skirt segments 23 as in retainer 17. If desired, nut 20 can be removably mounted on retainer 58 as shown in FIG. 8.

The manner of use and results achieved by the retainers of FIGS. 7 and 9 are the same as retainer 17 and can further include the modifications shown in FIGS. 5 and 6. The modified constructions of FIGS. 3–10 merely show the versatility and the various structural changes that can be made to the various components of the improved fastener to achieve different clamping and holding characteristics without effecting the concept of the invention.

Non-penetrating fasteners 1, 40 and 48 and the method of installation has a number of advantages over prior art fasteners, especially the penetrating type of fastener in addition to other known types of non-penetrating fasteners. The retainer is formed of a pliable resilient elastomeric material which will not pinch or harm the membrane when in clamped engagement therewith as in prior non-penetrating fasteners using a somewhat similar retainer since heretofore such a retainer had to be formed of a more rigid plastic material in order to form external threads therein for a threaded engagement with the locking cap. The improved fastener of the invention provides for a snap-fit or pressure engagement between the retainer and locking cap which is accomplished by the axial downward forcing movement of rigid cap 18 onto resilient retainer 17 to compress the annular skirt thereof inwardly and along the tapered sides of knob 13 after which locking bolt 19 secures cap 18 to the retainer. Although cap 18 in most installations will remain firmly engaged with retainer 17 to clamp the membrane against the base plate knob without locking bolt 19, it is highly desirable to use such a locking device to achieve the advantages not believed accomplished by prior art non-penetrating mechanical fasteners. The improved fastener insures a secure connection of the cap to the retainer, thus reducing accidental dislodgment of the cap by large wind forces and retards vandalism by increasing the difficulty of removing the caps from the associated retainers.

The retainers are formed of a resilient elastomeric material such as EPDM, polyurethane or other type of thermoplastic rubber to provide the desired clamping action against the trapped membrane without damaging the membrane and which eliminates the use of a lubricant as required in certain types of prior art fastening systems. Furthermore, bolt 15 and nut 20 which secure the end cap to the retainer can be replaced with other types of securing devices such as a rivet without effecting the concept of the invention.

The improved fastener is suitable for flat roofs as well as irregularly shaped roofs including spherical roofs, and requires no additional sealant as in prior art fastening systems.

Accordingly, the improved roof fastening system is simplified, provides an effective, safe, inexpensive, and efficient device which achieves all the enumerated objectives, provides for eliminating difficulties encountered with prior art devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details and materials shown or described.

Having now described the features, discoveries and principles of the invention, the manner in which the improved non-penetrating mechanical fastener for securing a flexible membrane to the upper surface of a roof is constructed and used, the characteristics of the construction, and the advantageous, new and useful results obtained, the new and useful structures, devices, elements, arrangements, parts, and combinations and method steps for installing the same are set forth in the appended claims.

What is claimed is:

1. A mechanical fastener for securing a flexible elastomeric sheet to the upper surface of a roof; said fastener including:

(a) a base plate formed with an upwardly extending projection adapted to be secured to the upper surface of the roof and underlie the elastomeric sheet;

(b) anchoring means for securing the base plate to the upper surface of the roof;

(c) resilient retainer means mounted on the base plate projection for engaging the elastomeric sheet located between said retainer means and projection;

(d) cap means mounted on the retainer means by a force-fit engagement with the retainer means for placing and maintaining the retainer means in a compressed state for clamping the elastomeric sheet between said retainer means and projection; and (e) locking means for locking the cap means on the retainer means to maintain the elastomeric sheet in clamped engagement between the base plate projection and retainer means.

2. The mechanical fastener defined in claim 1 in which the base plate has a flat disc-shaped bottom member; and in which the upwardly extending projection is a knob formed integrally with the disc-shaped bottom member and has a conical surface tapered downwardly inwardly toward said bottom member.

3. The mechanical fastener defined in claim 2 in which the projection is formed by an annular hollow conical wall terminating in a rounded circular upper edge.

4. The mechanical fastener defined in claim 3 in which a hole is formed in the disc shaped bottom member within the interior of the hollow conical wall; in which the anchoring means is a rigid anchor having a head and a shank; and in which the anchor shank extends through the hole to secure the base plate to the roof.

5. The mechanical fastener defined in claim 2 in which a plurality of circumferentially spaced holes are formed in a circular pattern in the disc-shaped bottom member of the base plate; in which the anchoring means is a plurality of rigid anchors each having a head and a shank; and in which the anchor shanks extend through certain of the holes to secure the base plate to the roof.

6. The mechanical fastener defined in claim 1 in which the base plate and cap means are formed of a rigid plastic material.

7. The mechanical fastener defined in claim 1 in which the retainer means has a generally annular configuration with a disc-shaped end wall and outwardly flared skirt formed integrally with the end wall and extending generally axially therefrom.

8. The mechanical fastener defined in claim 7 in which the skirt is formed by a plurality of circumferentially spaced segments.

9. The mechanical fastener defined in claim 7 in which the locking means includes a bolt and a nut; and in which the nut is mounted on the retainer means and the bolt extends through an opening formed in a top wall of the cap means and engages the nut to clamp the retainer means against the cap means.

10. The mechanical fastener defined in claim 7 in which the cap means includes a generally cylindrical-shaped housing formed by a side wall open at one end and having an end wall at an opposite end; and in which the housing is slidably mounted on the retainer means through the open end with the outwardly flared skirt being compressed inwardly by the housing side wall to place the retainer means in the compressed state clamping the skirt about the base plate projection.

11. The mechanical fastener defined in claim 10 in which the housing side wall has a generally conical inner surface tapered inwardly toward the open end of the housing.

12. The mechanical fastener defined in claim 10 in which the flared skirt of the retainer means is formed with an outwardly projecting rib extending generally circumferentially about the skirt; and in which said rib is seated within a groove formed in an inside surface of the housing side wall.

13. The mechanical fastener defined in claim 9 in which the nut includes a disc-shaped base and an upstanding boss; and in which a threaded hole is formed in the boss.

14. The mechanical fastener defined in claim 9 in which the retainer means is formed of an elastomeric material; and in which the nut is molded withn said elastomeric material.

15. The mechanical fastener defined in claim 7 in which the outwardly flared skirt of the means has a cylindrical inner surface and a tapered outer surface; and in which the skirt increases in thickness in a direction away from the disc-shaped end wall.

16. The mechanical fastener defined in claim 1 in which the locking means includes a rigid shank; and in which the rigid shank extends through an opening formed in a top wall of the cap means and engages the retainer means for clamping the retainer means against the cap means.

17. A method for mechanically securing a flexible elastomeric sheet to the upper surface of a roof via the use of a plurality of spaced non-penetrating fastening devices, each of said fastening devices includes a base plate and a locking cap assembly with said base plate having an upstanding knob, and with said locking cap assembly including a resilient retainer, a rigid cap and a locking device; and anchoring means for securing said base plate to said roof upper surface; said method comprising the steps of:

(a) anchoring a plurality of the base plates at spaced locations to the upper surface of the roof;

(b) spreading the flexible elastomeric sheet over the roof upper surface and anchored base plate;

(c) placing a resilient retainer and cap on the elastomeric sheet above the knob of each of the base plates;

(d) forcing the cap toward the base plate to move the retainer into the cap and compressing the retainer about the base plate knob to clamp and secure the elastomeric sheet between the knob and retainer; and (e) securing the retainer to the cap by the locking device.

18. The method defined in claim 17 wherein the resilient retainer has an outwardly flared skirt which is compressed about the base plate knob as the retainer is moved in the cap and toward said knob.

19. The method defined in claim 18 wherein the skirt is formed with an outwardly projecting rib which sets within an internal groove formed in the cap when the retainer is compressed and moved into said cap.

20. The method defined in claim 18 wherein the cap has a generally cylindrical wall into which the retainer is moved and compressed; and in which said cylindrical cap wall has a conical inner surface which slidably engages the retainer skirt as the retainer is moved in the cap.

21. The method defined in claim 17 wherein the locking device includes a threaded nut mounted on the retainer and a locking bolt which engages said nut to secure the retainer to the cap.

22. The method defined in claim 17 wherein the base plate includes a flat bottom member formed with at least one hole; and in which said flat bottom member is placed against the upper surface of the roof and secured thereto by the anchoring means which extends through said hole.

* * * * *